US010822871B2

(12) United States Patent
Chen

(10) Patent No.: US 10,822,871 B2
(45) Date of Patent: Nov. 3, 2020

(54) DOUBLE-LAYER CORD ROLLING DEVICE FOR NON-PULL CORD WINDOW BLIND

(71) Applicant: Po-Yu Chen, Taichung (TW)

(72) Inventor: Po-Yu Chen, Taichung (TW)

(73) Assignee: Jumbo Home Deco. Corporation, Cayman Islands (KY)

( * ) Notice: Subject to any disclaimer, the term of this patent is extended or adjusted under 35 U.S.C. 154(b) by 84 days.

(21) Appl. No.: 16/161,462

(22) Filed: Oct. 16, 2018

(65) Prior Publication Data

US 2019/0292845 A1 Sep. 26, 2019

(30) Foreign Application Priority Data

Mar. 20, 2018 (TW) ..... 107109438 A

(51) Int. Cl.
*E06B 9/322* (2006.01)

(52) U.S. Cl.
CPC ..... *E06B 9/322* (2013.01); *E06B 2009/3222* (2013.01); *E06B 2009/3225* (2013.01)

(58) Field of Classification Search
CPC ..... E06B 9/322; E06B 2009/3222; E06B 2009/3225; E06B 9/60; B65H 79/00; B65H 75/34; F03G 1/06
See application file for complete search history.

(56) References Cited

U.S. PATENT DOCUMENTS

| | | | | |
|---|---|---|---|---|
| 6,508,293 | B1 * | 1/2003 | Huang | E06B 9/322 160/170 |
| 6,536,503 | B1 * | 3/2003 | Anderson | E06B 9/262 160/170 |
| 9,272,875 | B2 * | 3/2016 | Lin | B65H 57/00 |
| 9,574,396 | B2 * | 2/2017 | Toti | E06B 9/322 |
| 2012/0032019 | A1 * | 2/2012 | Chen | E06B 9/322 242/378 |
| 2014/0224431 | A1 * | 8/2014 | Lin | A47H 5/032 160/84.01 |
| 2017/0107075 | A1 * | 4/2017 | Hung | E06B 9/32 |
| 2017/0204656 | A1 * | 7/2017 | Chen | E06B 9/322 |
| 2017/0211321 | A1 * | 7/2017 | Chen | E06B 9/262 |
| 2017/0254144 | A1 * | 9/2017 | Chen | B65H 57/14 |
| 2019/0162016 | A1 * | 5/2019 | Chen | B65H 79/00 |
| 2019/0162278 | A1 * | 5/2019 | Chen | E06B 9/322 |
| 2019/0211624 | A1 * | 7/2019 | Lei | A47H 5/02 |

* cited by examiner

*Primary Examiner* — Katherine W Mitchell
*Assistant Examiner* — Abe Massad
(74) *Attorney, Agent, or Firm* — Rosenberg, Klein & Lee

(57) ABSTRACT

A double-layer cord rolling device includes a driving unit, and a cord rolling unit disposed under the driving unit. The driving unit has an upper base, two torsion spring gears rotatably disposed in the upper base and engaged with each other, and a torsion spring connecting the two torsion spring gears. The cord rolling unit has a lower base connected with the upper base, two cord rolling wheels disposed in the lower base in a way that they are capable of rotating synchronously and coaxial with the torsion spring gears respectively, and two lift transmission cords connected to the two cord rolling wheels respectively. A transmission shaft is employed to connect a torsion spring gear and a corresponding one of the cord rolling wheels, enabling them to rotate synchronously.

10 Claims, 12 Drawing Sheets

DOUBLE-LAYER CORD ROLLING DEVICE FOR NON-PULL CORD WINDOW BLIND

BACKGROUND OF THE INVENTION

1. Field of the Invention

The present invention relates to window blinds and more particularly, to a double-layer cord rolling device for a non-pull cord window blind.

2. Description of the Related Art

In general, as to the non-pull cord window blind, it uses its cord rolling device disposed in the top beam thereof to roll up the lift transmission cords. Owing that the lift transmission cords are connected to the bottom beam, the bottom beam can be gradually moved up relative to the top beam when the lift transmission cords are being rolled up, so that the slats of the window blind can be piled up and raised by upwardly moving the bottom beam.

The aforesaid cord rolling device is workable for normal-sized window blind. However, for the special-sized (e.g. long narrow type) window blinds, subject to the length of the aforesaid cord rolling device, the cord rolling device is likely to interfere with other components of the window blind. Therefore, it would be a desired goal in the window blind field to shorten the length of the aforesaid cord rolling device appropriately without affecting the functioning of the cord rolling device.

SUMMARY OF THE INVENTION

It is a primary objective of the present invention to provide a double-layer cord rolling device for the non-pull cord window blind, which is shorter in length, thereby attaining the effect of miniaturization.

To attain the above objective, the double-layer cord rolling device of the present invention includes a driving unit, a cord rolling unit, and a first transmission shaft. The driving unit has an upper base, a first torsion spring gear, a second torsion spring gear, and a torsion spring. The first and second torsion spring gears are rotatably disposed in the upper base and engaged with each other. The torsion spring connects the first and second torsion spring gears. The cord rolling unit has a lower base, a first cord rolling wheel, a second cord rolling wheel, and two lift transmission cords. The lower base is connected with the upper base of the driving unit. The first and second cord rolling wheels are disposed in the lower base in a way that the first and second cord rolling wheels are capable of rotating synchronously and coaxial with the first and second torsion spring gears of the driving unit respectively. An end of one of the two lift transmission cords is connected to the first cord rolling wheel, and an end of the other lift transmission cord is connected to the second cord rolling wheel, so that the two lift transmission cords can be wound around the first and second cord rolling wheels or released from the first and second cord rolling wheels through the rotation of the first and second cord rolling wheels respectively. The first transmission shaft connects the first torsion spring gear of the driving unit and the first cord rolling wheel of the cord rolling unit, enabling the first torsion spring gear and the first cord rolling wheel to rotate synchronously.

According to the above description of the double-layer cord rolling device of the present invention, the driving unit and the cord rolling unit are combined together in a stacking manner, and the first transmission shaft enables the driving unit to drive the cord rolling unit to operate with the driving unit synchronously. As a result, the double-layer cord rolling device is shortened in length on the whole without affecting its functioning, thereby attaining the effect of miniaturization.

Preferably, the first cord rolling wheel has a first axial portion, a first upper toothed disc portion and a first lower toothed disc portion; the first axial portion is connected with a corresponding one of the lift transmission cords; the first upper toothed disc portion is connected to a top end of the first axial portion; the first lower toothed disc portion is connected to a bottom end of the first axial portion; the second cord rolling wheel has a second axial portion, a second upper toothed disc portion and a second lower toothed disc portion; the second axial portion is connected with a corresponding one of the lift transmission cords the second upper toothed disc portion is connected to a top end of the second axial portion and engaged with the first upper toothed disc portion of the first cord rolling wheel; the second lower toothed disc portion is connected to a bottom end of the second axial portion and engaged with the first lower toothed disc portion of the first cord rolling wheel. As a result, the first and second cord rolling wheels can rotate synchronously through the engagement and transmission therebetween.

Preferably, the second torsion spring gear of the driving unit and the second cord rolling wheel of the cord rolling unit are connected by a second transmission shaft. Besides, the first cord rolling wheel has a first axial portion, a first upper disc portion and a first lower disc portion; the first axial portion is connected with a corresponding one of the lift transmission cords; the first upper disc portion is connected to a top end of the first axial portion; the first lower disc portion is connected to a bottom end of the first axial portion; the second cord rolling wheel has a second axial portion, a second upper disc portion and a second lower disc portion; the second axial portion is connected with a corresponding one of the lift transmission cords; the second upper disc portion is connected to a top end of the second axial portion and separated from the first upper disc portion of the first cord rolling wheel by a predetermined distance therebetween; the second lower disc portion is connected to a bottom end of the second axial portion and separated from the first lower disc portion of the first cord rolling wheel by a predetermined distance therebetween. As a result, the first and second cord rolling wheels can be driven by the first and second torsion spring fears respectively to rotate synchronously.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE INVENTION

Figure 1:
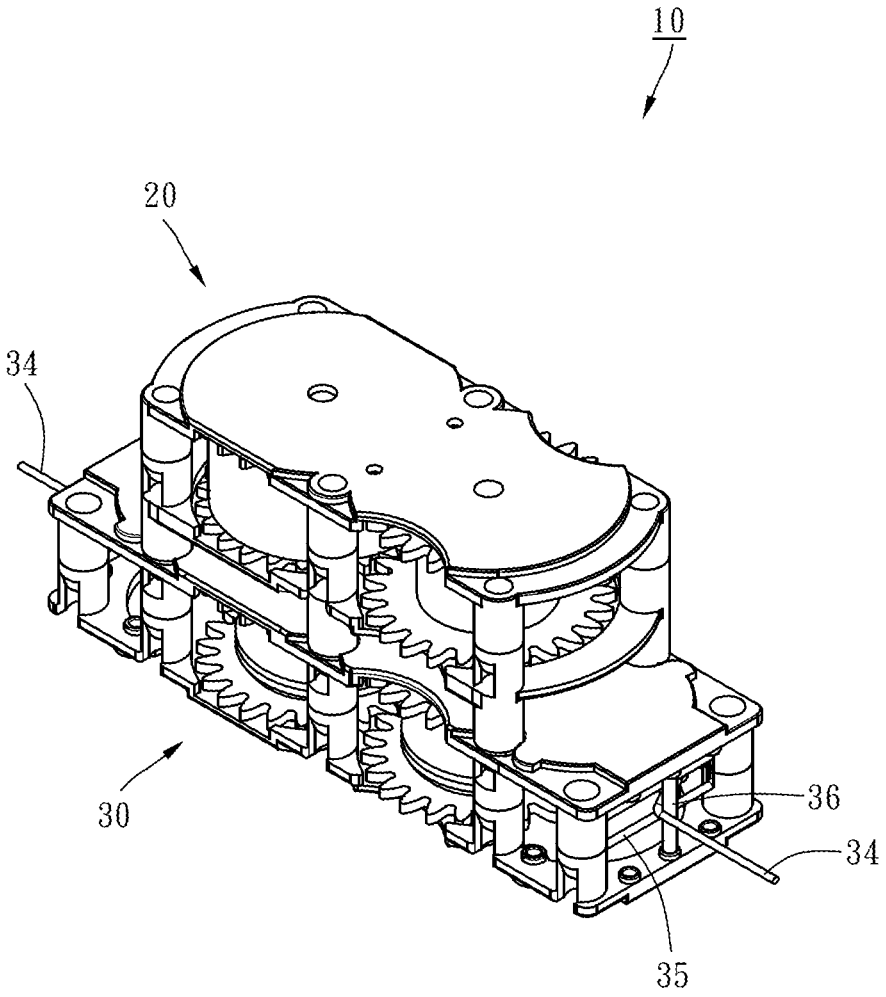
FIG. 1 is a perspective view of the appearance of a first embodiment of the present invention.

First of all, it is to be mentioned that same reference numerals used in the following preferred embodiments and the appendix drawings designate same or similar elements or structural features thereof.

Figure 2:
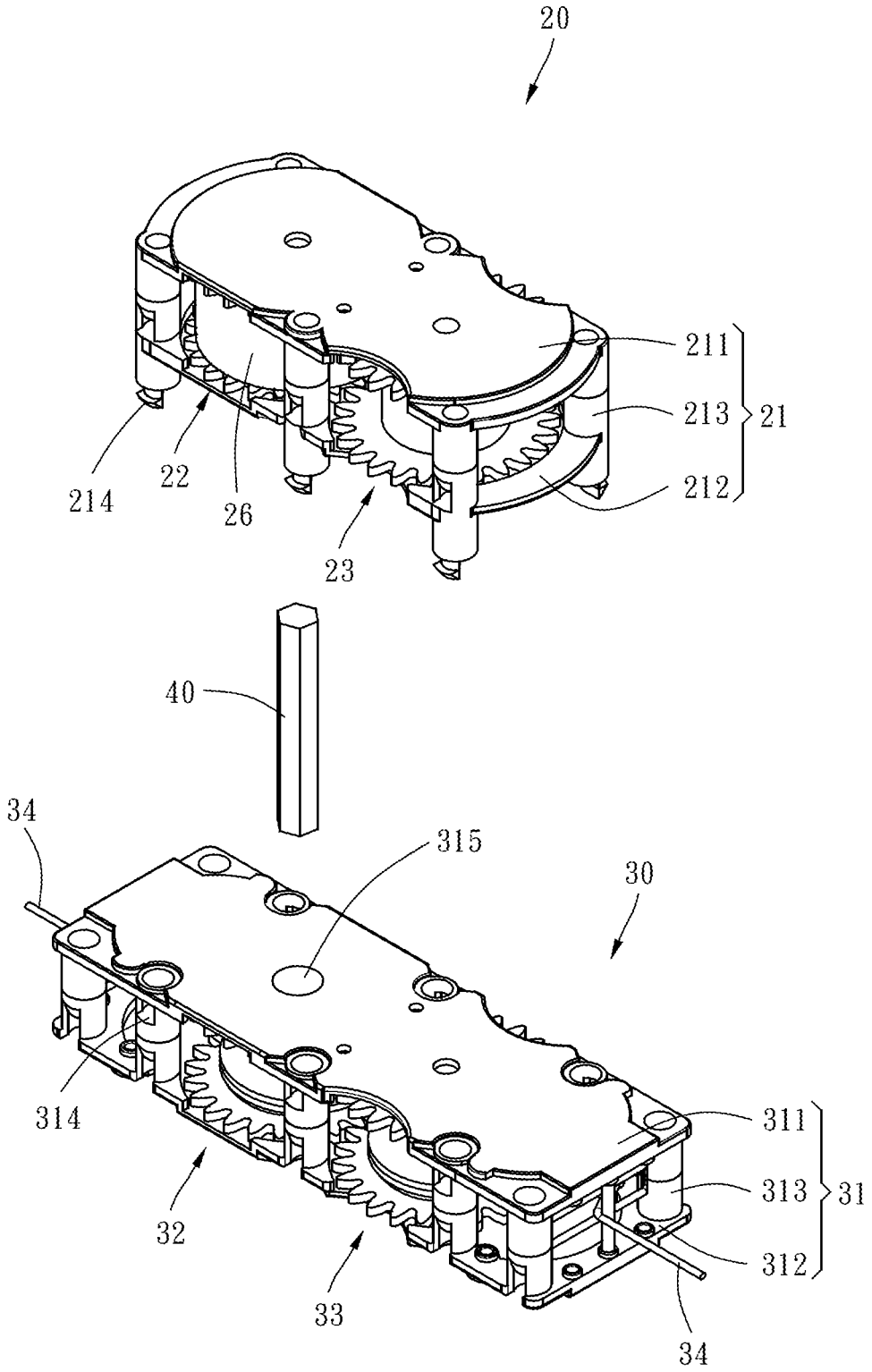
FIG. 2 is a partially exploded perspective view of the first embodiment of the present invention.

Referring to FIGS. 1-2, a double-layer cord rolling device 10 of the present invention includes a driving unit 20, a cord rolling unit 30, and a first transmission shaft 40.

The driving unit 20 has an upper base 21, a first torsion spring gear 22, a second torsion spring gear 23, and a torsion spring 26.

Figure 4:
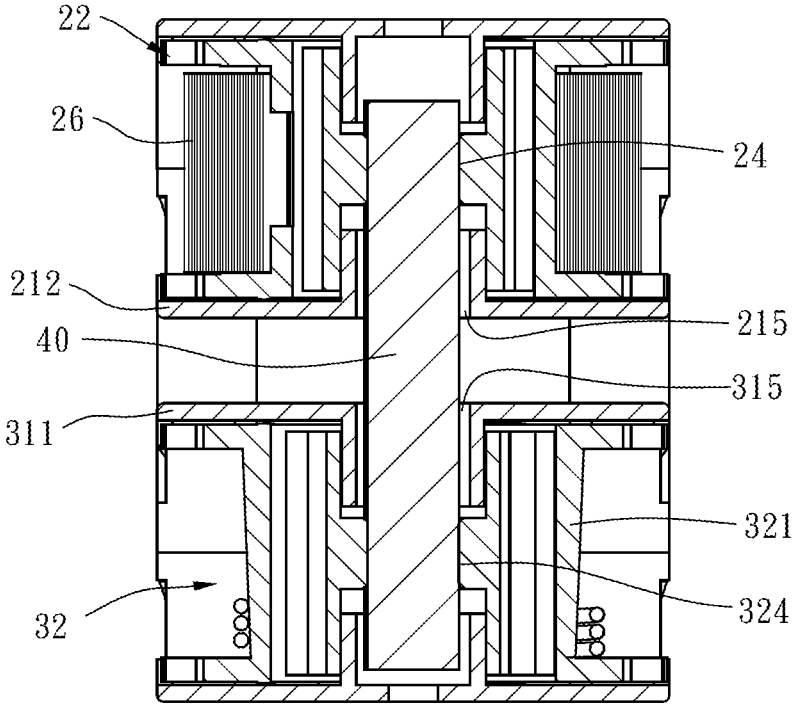
FIG. 4 is a partially sectional view of the first embodiment of the present invention.

The upper base 21 has a first top plate 211 and a first bottom plate 212. The first top and bottom plates 211 and 212 are connected by a plurality of first supporting posts 213. Each of the first supporting posts 213 is provided at the bottom end thereof with a hook portion 214. Besides, in this embodiment, the first bottom plate 212 is provided on the bottom surface thereof with a bottom hole 215, as shown in FIG. 4.

Figure 3:
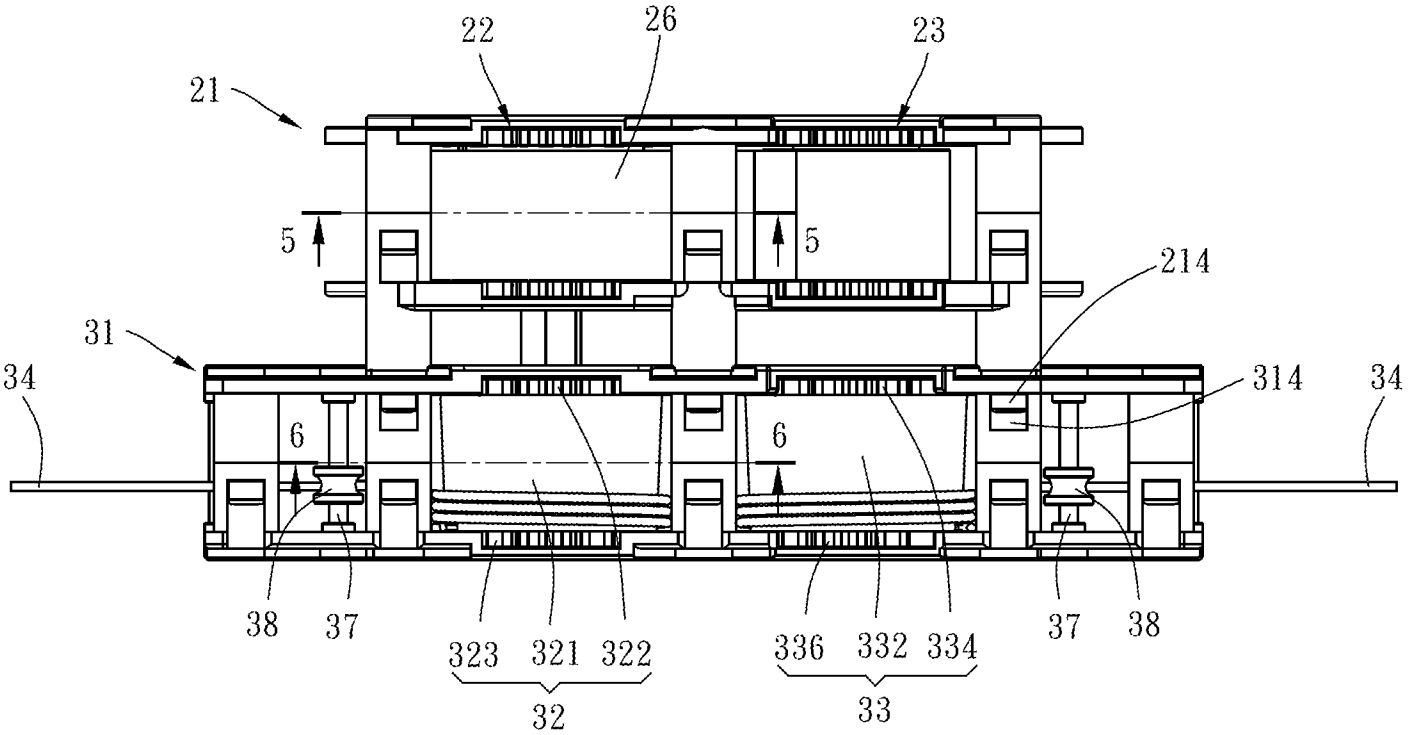
FIG. 3 is a front view of the first embodiment of the present invention.
Figure 5:
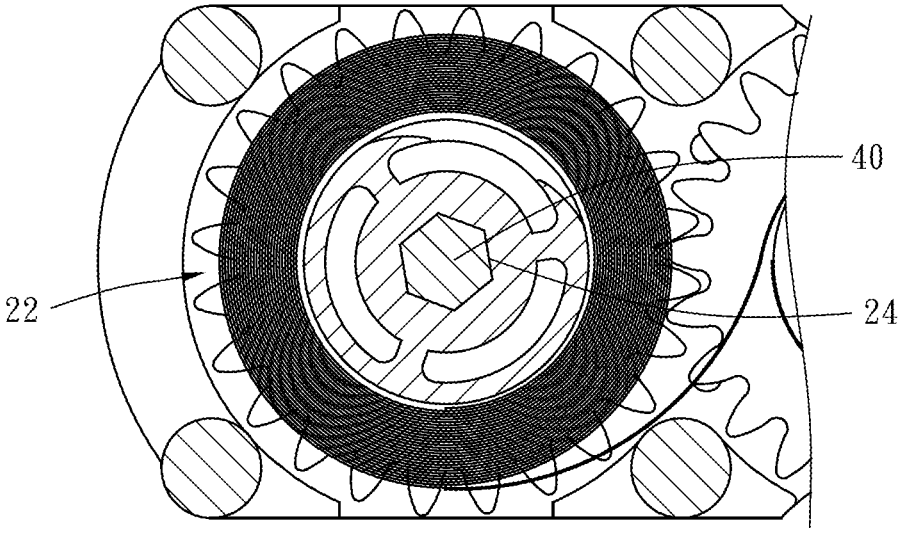
FIG. 5 is a sectional view taken along the cross-sectional line 5-5 in FIG. 3.

The first and second torsion spring gears 22 and 23 are rotatably disposed in the upper base 21 and engaged with each other, so that the first and second torsion spring gears 22 and 23 are rotatable synchronously. As shown in FIGS. 3-5, the first torsion spring gear 22 has a first upper polygonal axial hole 24, such as the hexagonal hole shown in FIG. 5. The first upper polygonal axial hole 24 corresponds to the bottom hole 215 of the first bottom plate 212 of the upper base 21.

The torsion spring 26 connects the first and second torsion spring gears 22 and 23 for providing resilient force to drive the first and second torsion spring gears 22 and 23 to rotate synchronously.

The cord rolling unit 30 has a lower base 31, a first cord rolling wheel 32, a second cord rolling wheel 33, and two lift transmission cords 34.

The lower base 31 has a second top plate 311 and a second bottom plate 312. The second top and bottom plates 311 and 312 are connected by a plurality of second supporting posts 313. The second top plate 311 is provided on the top surface thereof with a top hole 315. As shown in FIG. 4, the top hole 315 corresponds to the bottom hole 215 of the first bottom plate 212 of the upper base 21. Besides, as shown in FIG. 2, the second top plate 311 is provided on the top surface thereof with six hook grooves 314. The six hook grooves 314 correspond to the hook portions 214 of the upper base 21 one on one. In this way, as shown in FIG. 3, the upper and lower bases 21 and 31 can be combined together in a way that the hook portions 214 of the upper base 21 are hooked in the hook grooves 314 of the lower base 31. However, the upper and lower bases 21 and 31 can be separated once the hook relation between the hook portions 214 and the hook grooves 314 is released.

The first and second cord rolling wheels 32 and 33 are rotatably disposed in the lower base 31. In this embodiment, as shown in FIG. 3, the first cord rolling wheel 32 has a first axial portion 321, a first upper toothed disc portion 322 and a first lower toothed disc portion 323. The first upper and lower toothed disc portions 323 and 322 are connected to the top and bottom ends of the first axial portion 321 respectively. The second cord rolling wheel 33 has a second axial portion 332, a second upper toothed disc portion 334 and a second lower toothed disc portion 336. The second upper and lower toothed disc portions 334 and 336 are connected to the top and bottom ends of the second axial portion 332 respectively. Besides, the second upper and lower toothed disc portions 334 and 336 of the second cord rolling wheel 33 are engaged with the first upper and lower toothed disc portions 323 and 322 respectively, so that the first and second cord rolling wheels 32 and 33 can rotate synchronously through the engagement and transmission therebetween. In addition, the first axial portion 321 of the first cord rolling wheel 32 has a first lower polygonal axial hole 324, such as the hexagonal hole shown in FIGS. 4 and 6. The first lower polygonal axial hole 324 corresponds to the top hole 315 of the second top plate 311 of the lower base 31.

As shown in FIG. 3, an end of one of the two lift transmission cords 34 is connected to the first axial portion 321 of the first cord rolling wheel 32, and an end of the other lift transmission cord 34 is connected to the second axial portion 332 of the second cord rolling wheel 33. The other ends of the two lift transmission cords 34 are both connected to a bottom beam, which is the conventional technique and not shown in the figures.

Figure 6:
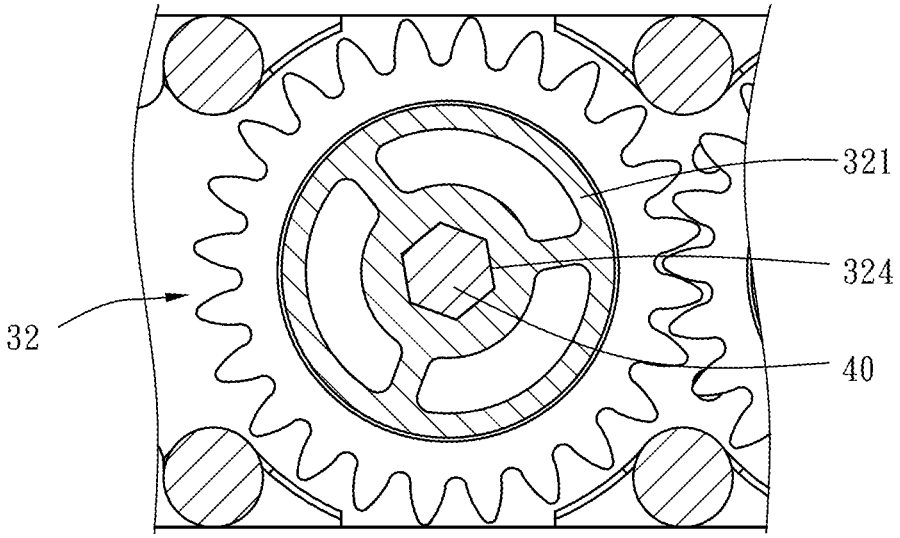
FIG. 6 is a sectional view taken along the cross-sectional line 6-6 in FIG. 3.

The first transmission shaft 40 is hexagon-shaped in cross section. The top of the first transmission shaft 40 is inserted through the bottom hole 215 of the first bottom plate 212 of the upper base 21 and engaged with the first upper polygonal axial hole 24 of the first torsion spring gear 22, as shown in FIGS. 4-5. The bottom of the first transmission shaft 40 is inserted through the top hole 315 of the second top plate 311 of the lower base 31 and engaged with the first lower polygonal axial hole 324 of the first cord rolling wheel 32, as shown in FIGS. 4 and 6. Owing that the first transmission shaft 40, the first upper polygonal axial hole 24 and the first lower polygonal axial hole 324 are all polygon-shaped in cross section, the first torsion spring gear 22 and the first cord rolling wheel 32 can rotate synchronously through the first transmission shaft 40.

According to the above illustration, when the two lift transmission cords 34 are pulled out to gradually escape from the first and second cord rolling wheels 32 and 33, the first and second cord rolling wheels 32 and 33 rotate synchronously. The first cord rolling wheel 32 drives the first torsion spring gear 22 through the first transmission shaft 40, so that the first torsion spring gear 22 drives the second torsion spring gear 23 through the engagement therebetween. At this time, the torsion spring 26 is stretched by the first and second torsion spring gears 22 and 23 so as to save resilient force. When the pulling force applied on the two lift transmission cords 34 is relieved, the resilient force of the torsion spring 26 is applied on the first and second torsion spring gears 22 and 23 to cause the first and second torsion spring gears 22 and 23 to rotate reversely and synchronously. The first torsion spring gear 22 drives the first cord rolling wheel 32 through the first transmission shaft 40, and then the first cord rolling wheel 32 drives the second cord rolling wheel 33 through the engagement therebetween, so that the first and second cord rolling wheels 32 and 33 roll up the associated lift transmission cords 34 respectively.

On the other hand, as shown in FIG. 1, the cord rolling unit 30 further has two limiting rings 35 and two vertical rods 36. The two limiting rings 35 are disposed at two ends of the lower base 31, and the lift transmission cords 34 are inserted through the limiting rings 35 respectively, so that the two lift transmission cords 34 are limited to operate in specific areas defined by the limiting rings 35. The two vertical rods 36 are disposed at the two ends of the lower base 31 and abutted against the lift transmission cords 34 respectively. Therefore, when being rolled up by the first and second cord rolling wheels 32 and 33, the two lift transmission cords 34 displace along the axial direction of the two vertical rods 36 respectively thereby capable of being wound around the first and second cord rolling wheels 32 and 33 coordinately.

Besides, as shown in FIG. 3, the cord rolling unit 30 further has two guiding wheel shafts 37 and two guiding wheels 38. The two guiding wheel shafts 37 are disposed at two ends of the lower base 31 and located adjacent to the first and second cord rolling wheels 32 and 33 respectively. The two guiding wheels 38 are rotatably disposed on the two guiding wheel shafts 37 and support the lift transmission cords 34 respectively, on one hand providing guiding function to the two lift transmission cords 34, and on the other hand providing appropriate tension to the two lift transmission cords 34 to have.

Figure 7:
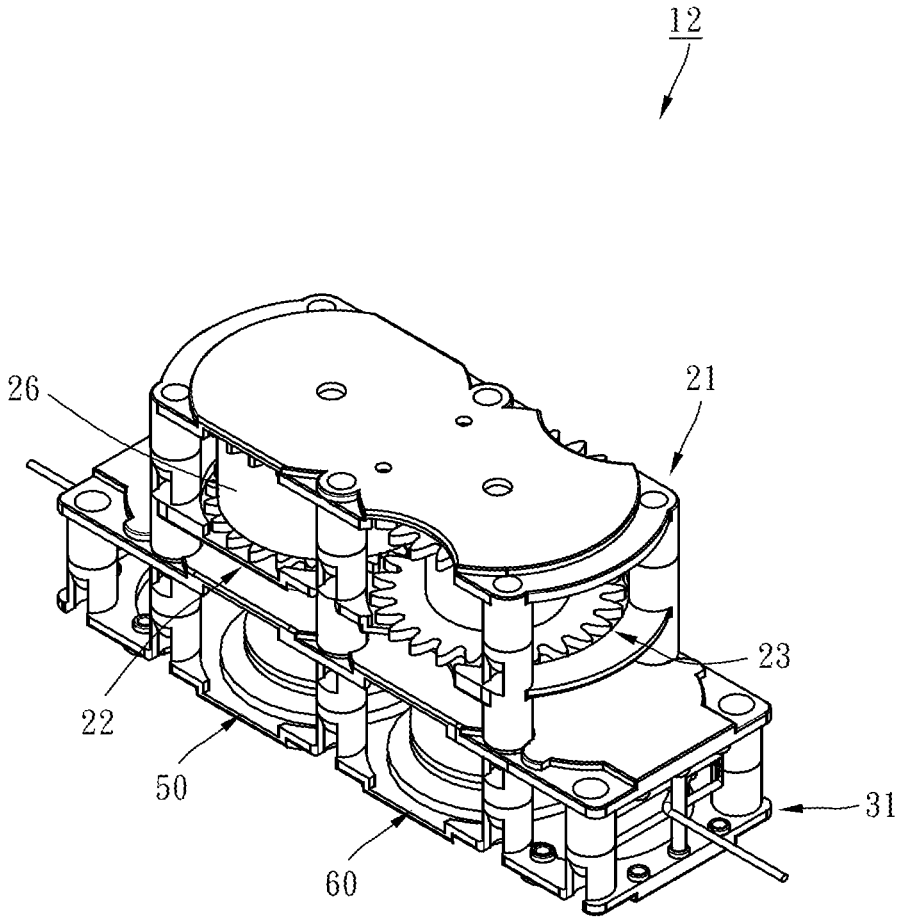
FIG. 7 is a perspective view of the appearance of a second embodiment of the present invention.
Figure 8:
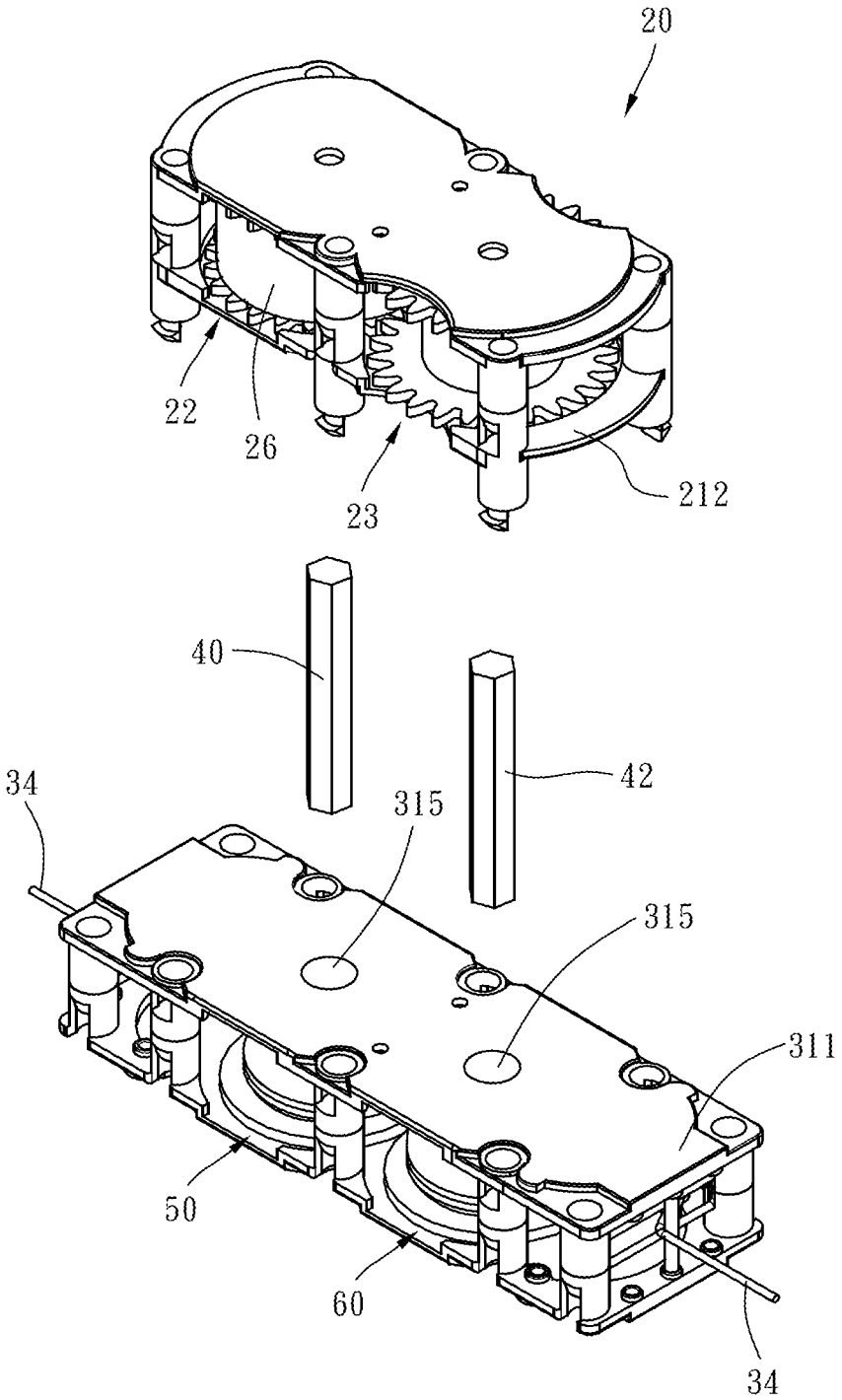
FIG. 8 is a partially exploded perspective view of the second embodiment of the present invention.

Referring to FIGS. 7-8, the double-layer cord rolling device 12 of the second embodiment of the present invention is provided as follows, which is different from that of the aforesaid embodiment in the structure of the first and second cord rolling wheels 50 and 60. Besides, the first and second cord rolling wheels 50 and 60 are not engaged with each other for transmission, but driven by the first and second torsion spring gears 22 and 23 respectively.

Figure 10:
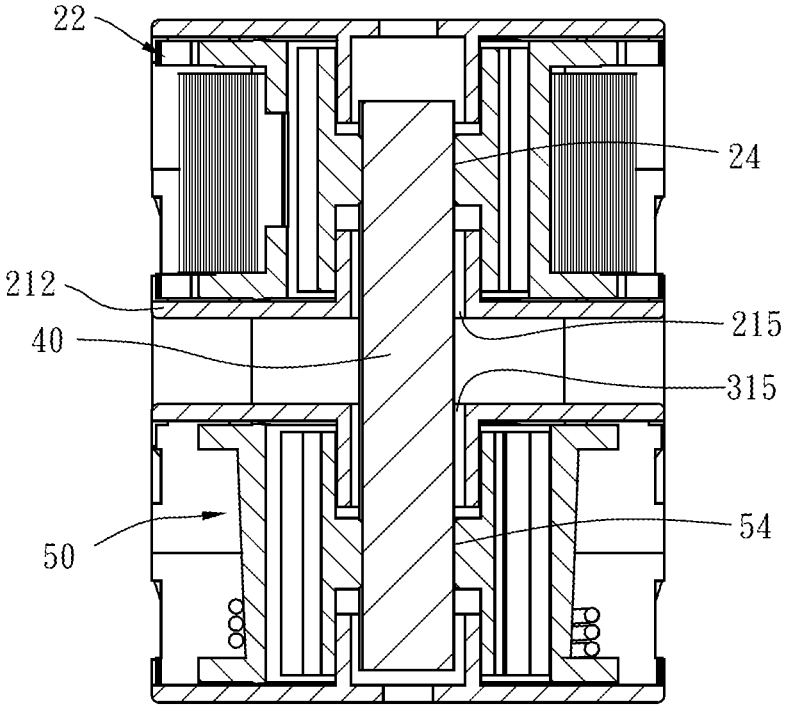
FIG. 10 is a partially sectional view of the second embodiment of the present invention, primarily showing a first torsion spring gear and a first cord rolling wheel are connected with each other by a first transmission shaft.
Figure 11:
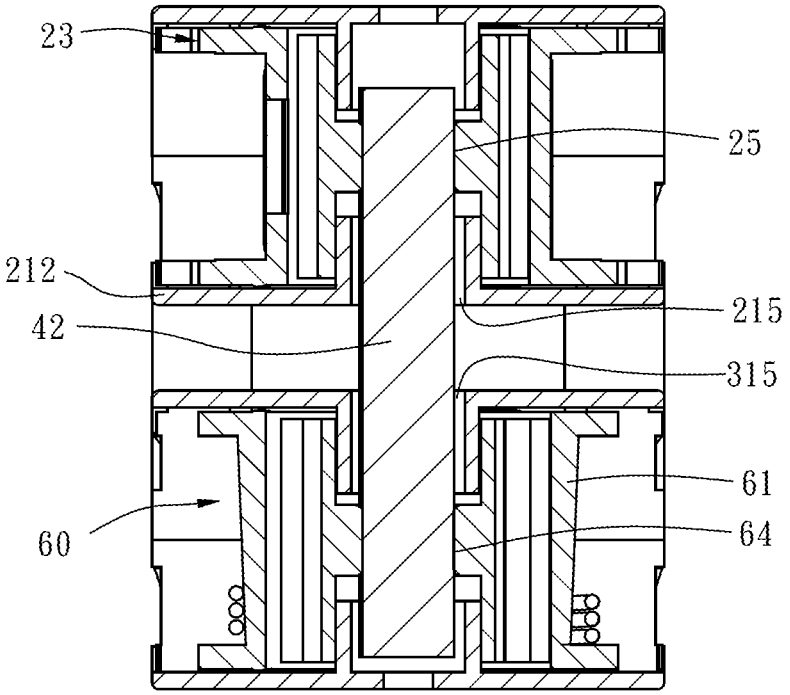
FIG. 11 is similar to FIG. 10, primarily showing a second torsion spring gear and a second cord rolling wheel are connected with each other by a second transmission shaft.

Specifically speaking, the driving unit 20 in this embodiment, which has an upper base 21, a first torsion spring gear 22, a second torsion spring gear 23 and a torsion spring 26, is slightly and structurally different from that in the aforesaid embodiment in that the first bottom plate 212 of the upper base 21 has two bottom holes 215. One of the bottom holes 215 corresponds to the first upper polygonal axial hole 24 of the first torsion spring gear 22, as shown in FIG. 10. The second torsion spring gear 23 further has a second upper polygonal axial hole 25, such as the hexagonal hole shown in FIG. 12. The second upper polygonal axial hole 25 corresponds to the other bottom hole 215 of the first bottom plate 212 of the upper base 21, as shown in FIG. 11. The first torsion spring gear 22 and the torsion spring 26 are the same with that in the aforesaid embodiment in structure, thereby not repeatedly mentioned here.

Figure 9:
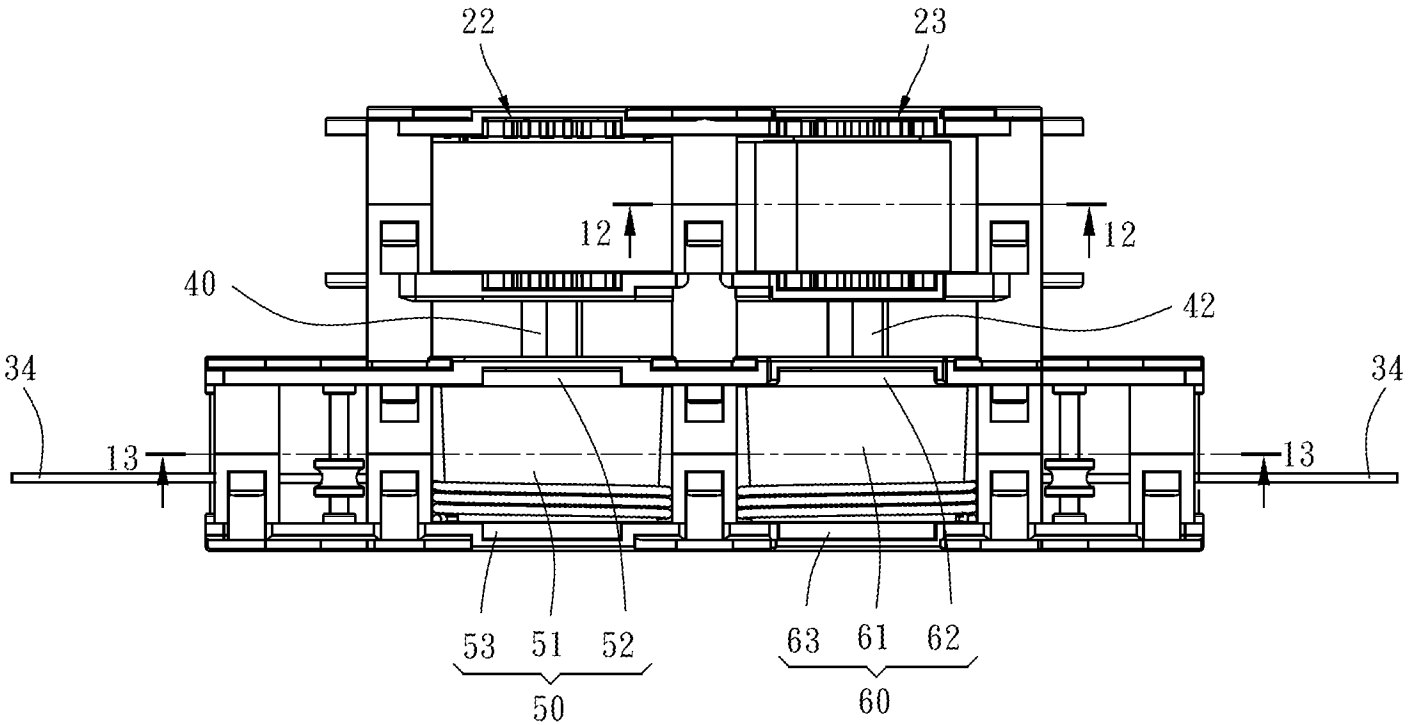
FIG. 9 is a front view of the second embodiment of the present invention.

The cord rolling unit 30 in this embodiment, which has a lower base 31, first cord rolling wheel 50, a second cord rolling wheel 60 and two lift transmission cords 34, is slightly and structurally different from that in the aforesaid embodiment in that the second top plate 311 of the lower base 31 has two top holes 315. One of the top holes 315 corresponds to the first lower polygonal axial hole 54 of the first cord rolling wheel 50, as shown in FIG. 10. As shown in FIG. 9, the first cord rolling wheel 50 has a first axial portion 51, a first upper disc portion 52 and a first lower disc portion 53. The first upper and lower disc portions 52 and 53 are connected to the top and bottom of the first axial portion 53. The second cord rolling wheel 60 has a second axial portion 61, a second upper disc portion 62 and a second lower disc portion 63. The second upper and lower disc portions 62 and 63 are connected to the top and bottom of the second axial portion 61. Besides, the first upper disc portion 52 of the first cord rolling wheel 50 and the second upper disc portion 62 of the second cord rolling wheel 60 are separated from each other by a predetermined distance therebetween. The first lower disc portion 51 of the first cord rolling wheel 50 and the second lower disc portion 63 of the second cord rolling wheel 60 are separated from each other by a predetermined distance therebetween. In addition, as shown in FIG. 11, the second axial portion 61 of the second cord rolling wheel 60 has a second lower polygonal axial hole 64, such as the hexagonal hole shown in FIG. 13. The second lower polygonal axial hole 64 corresponds to the other top hole 315 of the second top plate 311 of the lower base 31. The two lift transmission cords 34 are the same with that in the aforesaid embodiment in structure, thereby not repeatedly mentioned here.

Figure 12:
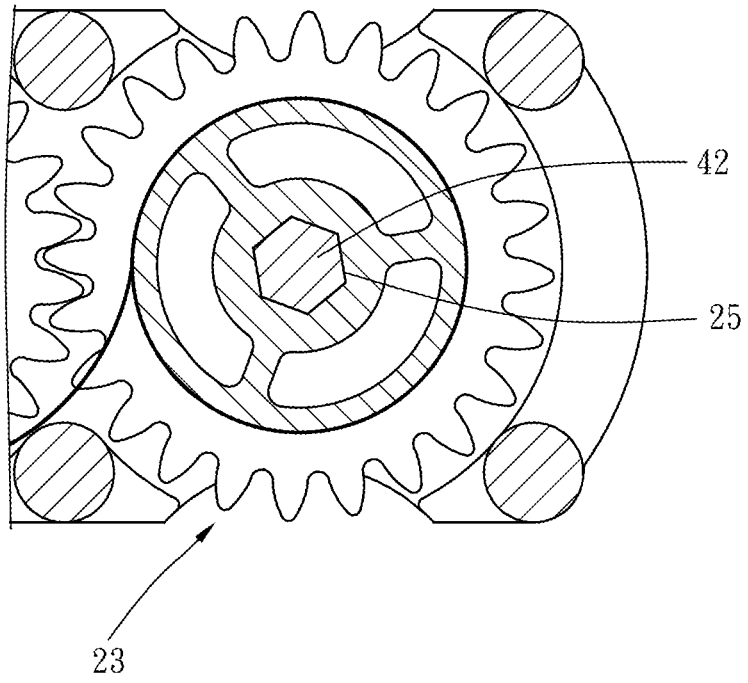
FIG. 12 is a sectional view taken along the cross-sectional line 12-12 in FIG. 9.
Figure 13:
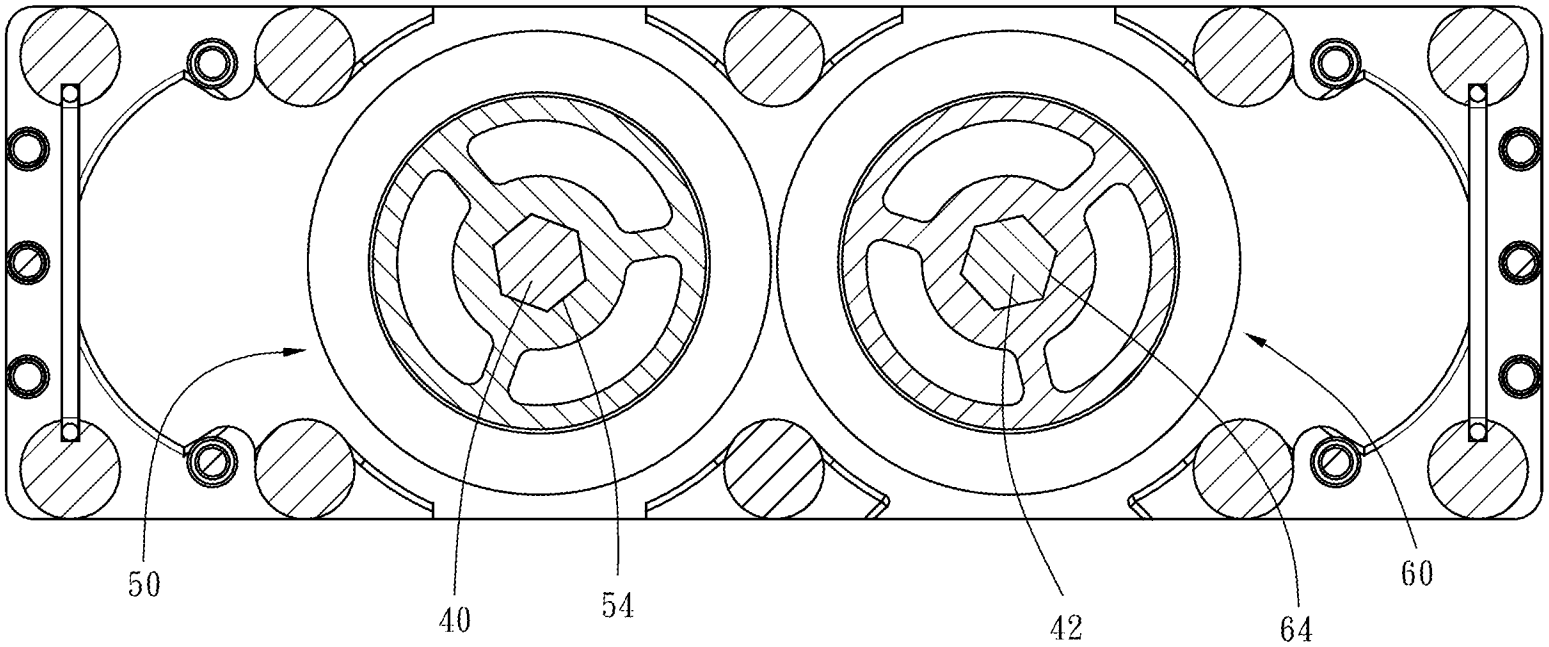
FIG. 13 is a sectional view taken along the cross-sectional line 13-13 in FIG. 9.

Except for the first transmission shaft 40, a second transmission shaft 42 is further provided in this embodiment. The second transmission shaft 42 is hexagon-shaped in cross section. The top of the second transmission shaft 42 is inserted through the secondary bottom hole 215 of the first bottom plate 212 of the upper base 21 and engaged with the second upper polygonal axial hole 25 of the second torsion spring gear 23, as shown in FIGS. 11-12. The bottom of the second transmission shaft 42 is inserted through the secondary top hole 315 of the second top plate 311 of the lower base 31 and engaged with the second lower polygonal axial hole 64 of the second cord rolling wheel 60, as shown in FIGS. 11 and 13. Owing that the second transmission shaft 42, the second upper polygonal axial hole 25 and the second lower polygonal axial hole 64 are all polygon-shaped in cross section, the second torsion spring gear 23 and the second cord rolling wheel 60 can rotate synchronously through the second transmission shaft 42.

According to the above illustration that when the two lift transmission cords 34 are pulled out to gradually escape from the first and second cord rolling wheels 50 and 60, the first and second cord rolling wheels 50 and 60 rotate synchronously. The first cord rolling wheel 50 drives the first torsion spring gear 22 through the first transmission shaft 40, and the second cord rolling wheel 60 drives the second torsion spring gear 23 through the second transmission shaft 42. At this time, the torsion spring 26 is stretched by the first and second torsion spring gears 22 and 23 so as to save resilient force. When the pulling force applied on the two lift transmission cords 34 is relieved, the resilient force of the torsion spring 26 is applied on the first and second torsion spring gears 22 and 23 to cause the first and second torsion spring gears 22 and 23 to rotate synchronously. The first torsion spring gear 22 drives the first cord rolling wheel 50 through the first transmission shaft 40, and the second torsion spring gear 23 drives the second cord rolling wheel 60 through the second transmission shaft 42, so that the first and second cord rolling wheels 50 and 60 roll up the associated lift transmission cords 34 respectively.

In conclusion, in the double-layer cord rolling device 10 or 12 of the present invention, the driving unit 20 and the cord rolling unit 30 are combined together in a stacking manner, and at least one transmission shaft is used for transmitting power. As a result, the double-layer cord rolling device is shortened in length on the whole without affecting the functioning thereof, thereby attaining the effect of miniaturization.

What is claimed is:

1. A double-layer cord rolling device for a non-pull cord window blind, the double-layer cord rolling device comprising:

a driving unit having an upper base, a first torsion spring gear, a second torsion spring gear and a torsion spring, the first and second torsion spring gears being rotatably disposed in the upper base and engaged with each other, the torsion spring connecting the first and second torsion spring gears;

a cord rolling unit having a lower base, a first cord rolling wheel, a second cord rolling wheel and two lift transmission cords, the lower base being connected with the upper base of the driving unit, the first and second cord rolling wheels being disposed in the lower base such that the first and second cord rolling wheels rotate synchronously, the first and second cord rolling wheels being coaxial with the first and second torsion spring gears of the driving unit respectively, an end of one of the two lift transmission cords being connected to the first cord rolling wheel, an end of the other lift transmission cord being connected to the second cord rolling wheel; and a first transmission shaft connecting the first torsion spring gear of the driving unit and the first cord rolling wheel of the cord rolling unit; wherein at least a portion of the lower base or upper base is configured to extend between the torsion spring gears and the cord rolling wheels.

2. The double-layer cord rolling device as claimed in claim 1, wherein:

the first cord rolling wheel has a first axial portion, a first upper toothed disc portion and a first lower toothed disc portion;

the first axial portion is connected with a corresponding one of the lift transmission cords;

the first upper toothed disc portion is connected to a top end of the first axial portion;

the first lower toothed disc portion is connected to a bottom end of the first axial portion;

the second cord rolling wheel has a second axial portion, a second upper toothed disc portion and a second lower toothed disc portion;

the second axial portion is connected with a corresponding one of the lift transmission cords;

the second upper toothed disc portion is connected to a top end of the second axial portion and engaged with the first upper toothed disc portion of the first cord rolling wheel; and the second lower toothed disc portion is connected to a bottom end of the second axial portion and engaged with the first lower toothed disc portion of the first cord rolling wheel.

3. The double-layer cord rolling device as claimed in claim 2, wherein:

the first torsion spring gear has a first upper polygonal axial hole;

the first cord rolling wheel has a first lower polygonal axial hole;

the first transmission shaft is polygonal-shaped in cross section;

a top of the first transmission shaft is engaged with the first upper polygonal axial hole of the first torsion spring gear; and a bottom of the first transmission shaft is engaged with the first lower polygonal axial hole of the first cord rolling wheel.

4. The double-layer cord rolling device as claimed in claim 1, further comprising a second transmission shaft connecting the second torsion spring gear of the driving unit and the second cord rolling wheel of the cord rolling unit.

5. The double-layer cord rolling device as claimed in claim 4, wherein:

the first cord rolling wheel has a first axial portion, a first upper disc portion and a first lower disc portion;

the first axial portion is connected with a corresponding one of the lift transmission cords;

the first upper disc portion is connected to a top end of the first axial portion;

the first lower disc portion is connected to a bottom end of the first axial portion;

the second cord rolling wheel has a second axial portion, a second upper disc portion and a second lower disc portion;

the second axial portion is connected with a corresponding one of the lift transmission cord;

the second upper disc portion is connected to a top end of the second axial portion and separated from the first upper disc portion of the first cord rolling wheel by a predetermined distance therebetween; and the second lower disc portion is connected to a bottom end of the second axial portion and separated from the first lower disc portion of the first cord rolling wheel by a predetermined distance therebetween.

6. The double-layer cord rolling device as claimed in claim 5, wherein:

the first torsion spring gear has a first upper polygonal axial hole;

the first cord rolling wheel has a first lower polygonal axial hole;

the first transmission shaft is polygonal-shaped in cross section;

a top of the first transmission shaft is engaged with the first upper polygonal axial hole of the first torsion spring gear;

a bottom of the first transmission shaft is engaged with the first lower polygonal axial hole of the first cord rolling wheel;

the second torsion spring gear has a second upper polygonal axial hole;

the second cord rolling wheel has a second lower polygonal axial hole;

the second transmission shaft is polygonal-shaped in cross section;

a top of the second transmission shaft is engaged with the second upper polygonal axial hole of the second torsion spring gear; and a bottom of the second transmission shaft is engaged with the second lower polygonal axial hole of the second cord rolling wheel.

7. The double-layer cord rolling device as claimed in claim 1, wherein:

the upper base has a plurality of hook portions;

the lower base has a plurality of hook grooves; and the hook portions of the upper base are detachably hooked in the hook grooves of the lower base respectively.

8. The double-layer cord rolling device as claimed in claim 1, wherein:

the cord rolling unit further has two limiting rings disposed at two ends of the lower base; and the lift transmission cords are inserted through the limiting rings respectively.

9. The double-layer cord rolling device as claimed in claim 1, wherein the cord rolling unit further has two vertical rods disposed at two ends of the lower base and abutted against the lift transmission cords respectively.

10. The double-layer cord rolling device as claimed in claim 1, wherein:

the cord rolling unit further has two guiding wheel shafts and two guiding wheels;

the two guiding wheel shafts are disposed at two ends of the lower base and located adjacent to the first and second cord rolling wheels respectively; and the two guiding wheels are rotatably disposed on the two guiding wheel shafts and support the lift transmission cords respectively.

* * * * *